US006081243A

United States Patent [19]

Lake

[11] Patent Number: 6,081,243

[45] Date of Patent: Jun. 27, 2000

[54] METHODS OF FORMING CONDUCTIVE LINES, METHODS OF FORMING ANTENNAS, METHODS OF FORMING WIRELESS COMMUNICATION DEVICES, CONDUCTIVE LINES, ANTENNAS, AND WIRELESS COMMUNICATIONS DEVICES

[75] Inventor: Rickie C. Lake, Eagle, Id.

[73] Assignee: Micron Technology, Inc., Boise, Id.

[21] Appl. No.: 08/926,189

[22] Filed: Sep. 9, 1997

[51] Int. Cl.[7] ..... H01Q 1/38

[52] U.S. Cl. ..... 343/873; 343/700 MS; 343/795; 156/630; 361/410

[58] Field of Search ..... 343/700 MS; 29/600; 361/777, 749, 410; 174/68.5; 428/546

[56] References Cited

U.S. PATENT DOCUMENTS

| | | | |
|---|---|---|---|
| 4,987,421 | 1/1991 | Sunahara et al. | 343/700 MS |
| 5,148,355 | 9/1992 | Lowe et al. | 361/410 |
| 5,364,493 | 11/1994 | Hunter, Jr. et al. | 156/630 |
| 5,475,241 | 12/1995 | Harrah et al. | 257/99 |
| 5,495,260 | 2/1996 | Couture | 343/795 |

OTHER PUBLICATIONS

U.S. Application No. 08/705,043, O'Toole et al., filed Aug. 29, 1996.

Sedlak, "Etching Outerlayer Printed Circuit Boards", RD Chemical Company, 1995–1996.

*Primary Examiner*—Don Wong

*Assistant Examiner*—James Clinger

*Attorney, Agent, or Firm*—Wells, St. John, Roberts, Gregory & Matkin, P.S.

[57] ABSTRACT

Methods of forming conductive lines, antennas, and wireless communications devices, and related conductive lines, antennas and wireless communications devices are described. In one aspect, a substrate having an outer surface is provided. A first layer of conductive material is formed over the outer surface. A second layer of conductive material is formed over only portions of the first layer. Using the second layer as a masking layer, the first layer is etched selectively relative thereto to provide a conductive line comprising the first and second layers. Preferably, the first layer is more conductive than the second layer. In a preferred implementation, the conductive line constitutes an antenna construction which is suitable for use in a wireless communications device. In another preferred implementation, an antenna, an integrated circuitry chip, and a battery are mounted on a substrate and operably interconnected to provide an integrated circuitry chip, with the antenna being formed as described above.

34 Claims, 3 Drawing Sheets

METHODS OF FORMING CONDUCTIVE LINES, METHODS OF FORMING ANTENNAS, METHODS OF FORMING WIRELESS COMMUNICATION DEVICES, CONDUCTIVE LINES, ANTENNAS, AND WIRELESS COMMUNICATIONS DEVICES

TECHNICAL FIELD

This invention relates generally to methods of forming conductive lines, methods of forming antennas, methods of forming wireless communication devices, and to conductive lines, antennas, and wireless communications devices.

BACKGROUND OF THE INVENTION

Often times during fabrication of various electronic devices, it is desirable to provide a conductive line which has a desired degree of conductivity. Yet, a desired material from which such conductive line is formed may not possess the requisite degree of conductivity. Accordingly, it would be desirable to form such conductive lines to have the desired degree of conductivity.

Some antennas are formed from conductive lines supported by a substrate. The conductivity of a particular antenna affects its operation, as such pertains to its electromagnetic behavior. For example, the conductivity can affect the resonance of such antennas, which can impact the overall frequencies at which such antennas operate.

Some wireless communications devices are very small and, by virtue of their dimensions, dictate the types and amounts of materials which can be utilized to form an antenna. In some instances, achieving a desired degree of conductivity might be possible by using more of a particular antenna-forming material, such as by making the conductive antenna lines thicker, wider, or longer, or in a different shape. Yet, the desired dimensions of such devices may preclude such modified configurations.

This invention arose out of concerns associated with providing more conductive antenna lines of desired materials without consuming more space on or over a substrate upon which the antenna lies. The artisan will appreciate applicability of the disclosed technology in other areas, with the invention only being limited by the accompanying claims appropriately interpreted in accordance with the Doctrine of Equivalents.

SUMMARY OF THE INVENTION

Methods of forming conductive lines, antennas, and wireless communications devices, and related conductive lines, antennas and wireless communications devices are described. In one aspect, a substrate having an outer surface is provided. A first layer of conductive material is formed over the outer surface. A second layer of conductive material is formed over only portions of the first layer. Using the second layer as a masking layer, the first layer is etched selectively relative thereto to provide a conductive line comprising the first and second layers. Preferably, the first layer is more conductive than the second layer. In a preferred implementation, the conductive line constitutes an antenna construction which is suitable for use in a wireless communications device. In another preferred implementation, an antenna, an integrated circuitry chip, and a battery are mounted on a substrate and operably interconnected to provide an integrated circuitry chip, with the antenna being formed as described above.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
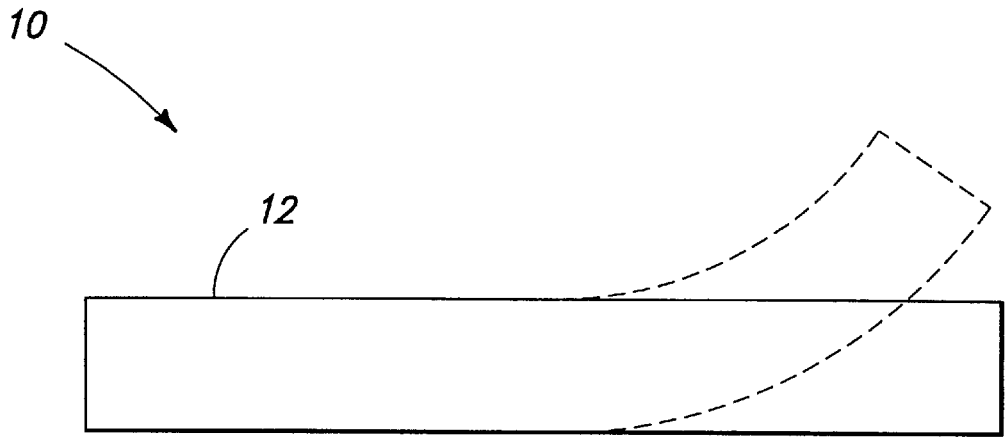
FIG. 1 is a cross-sectional view of a substrate in accordance with one aspect of the invention.

Referring to FIG. 1, a substrate is indicated generally at 10 and includes an outer surface 12. In one aspect, substrate 10 constitutes a polyester material which possesses a degree of flexibility prior to the processing which is described just below. Such flexibility is indicated generally in dashed lines.

Figure 2:
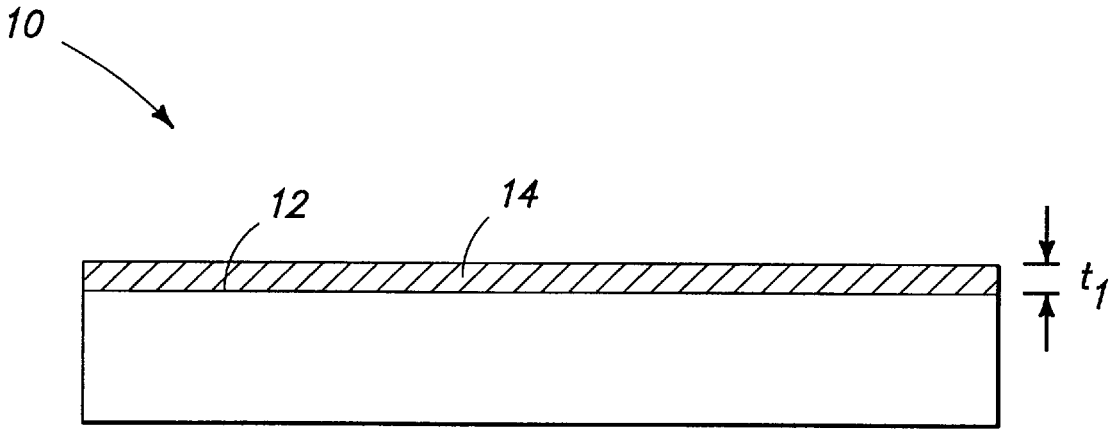
FIG. 2 is a view of the FIG. 1 substrate at a processing step subsequent to that shown by FIG. 1.

Referring to FIG. 2, a first conductive layer 14 having a first conductivity is formed over outer surface 12 and preferably comprises a metal-comprising material. In a preferred implementation, layer 14 constitutes a film layer comprising copper which is formed or coated over the substrate to a thickness $t_1$. An exemplary thickness for layer 14 is between about 0.03 mil to 2 mils.

Figure 3:
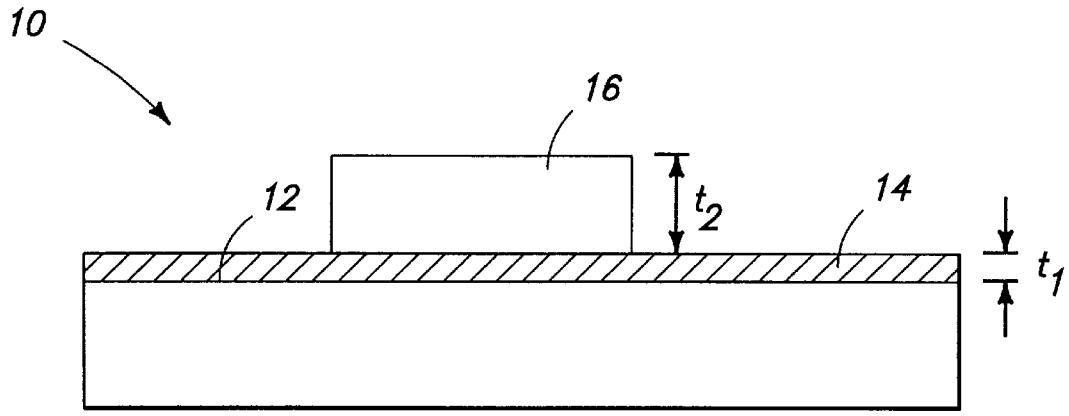
FIG. 3 is a view of the FIG. 1 substrate at a processing step subsequent to that shown by FIG. 2.

Referring to FIG. 3, a second conductive layer 16 having a second conductivity is formed over only portions of first layer 14 and accordingly masks those portions over which it is formed. Preferably, the first conductivity is greater than the second conductivity. Accordingly, those portions of layer 14 over which layer 16 material is not formed are not masked thereby. In a preferred aspect, the formation of layers 14, 16 comprises at least two separate steps. Layer 16 constitutes a conductive film line component which is preferably formed to a thickness $t_2$ which is greater than thickness $t_1$. An exemplary thickness for layer 16 is between about 0.3 mil to 2 mils. In a preferred aspect, layer 16 constitutes an antenna component in a desired antenna shape. An exemplary and preferred material for layer 16 comprises silver in the form of a silver-filled polymer layer. An example is part number P2607 available through a company called EMCA-REMEX of Montgomeryville, Pa. Other materials include carbon-filled polymer thick film inks. An exemplary material is a conductive carbon coating bearing part number M-5000-CR, available through a company called Minico of Congers, N.Y.

In a preferred aspect, layer 16 is printed directly onto layer 14, and even more preferably, such layer is screen-printed directly thereon. Accordingly, the screen-printing of layer 16 enables a pre-configured or pre-defined antenna component to be formed only over certain portions of first layer 14. It is possible, however, for other formation techniques to be utilized. Alternately considered, layers 14 and 16 constitute at least two layers of different conductive material which are formed over one another. One of the layers (the less conductive layer 16), is preferably formed over the other of the layers (the more conductive layer 14).

Figure 4:
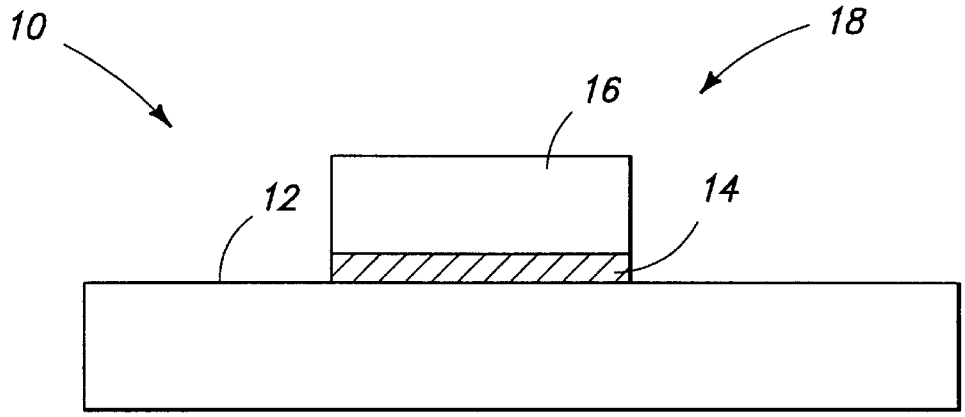
FIG. 4 is a view of the FIG. 1 substrate at a processing step subsequent to that shown by FIG. 3.

Referring to FIG. 4, a conductive device component 18 is formed over substrate 10 by selectively removing unmasked portions of layer 14 (FIG. 3) relative to layer 16. In a preferred aspect, unmasked portions of layer 14 are anisotropically etched. An exemplary etch chemistry where layer 14 is copper and layer 16 is a silver polymer comprises ammonia in combination with one or both of ammonium chloride or ammonium sulfate. Such provides an antenna having a composite construction with layers which are disposed in operative contact relative to one another such that the overall conductivity of device component 18 is greater than the conductivity of layer 16 material standing alone.

Figure 5:
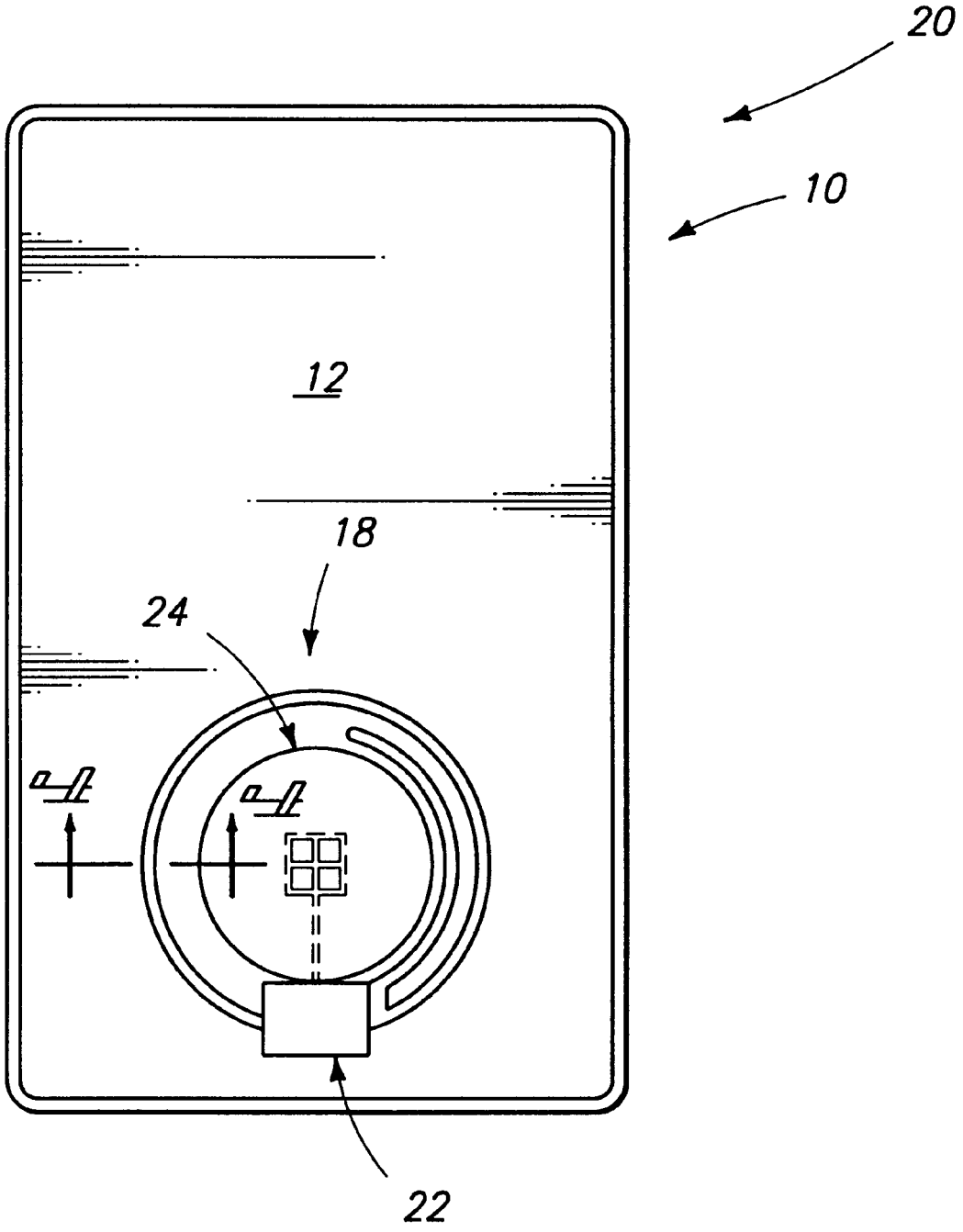
FIG. 5 is a view of a wireless communications device constructed in accordance with one aspect of the present invention.

Referring to FIG. 5, a wireless communication device is indicated generally at 20 and comprises substrate 10 and device component 18. Device component 18 is preferably in the form of an antenna which is configured for wireless radio frequency operation. In the illustrated example, the antenna constitutes a loop antenna. In a preferred aspect, an integrated circuitry chip 22 and a battery 24 are provided and mounted to substrate 10 and are in operative electrical communication with antenna or conductive device component 18. Communication device 20 is preferably encapsulated with an encapsulating material and configured for radio frequency communication. In one preferred aspect, wireless communication device 20 has an outer surface and a thickness relative thereto (into the plane of the page upon which FIG. 5 appears) of less than or equal to about 90 mils. Even more preferably, such thickness is less than or equal to about 30 mils. An exemplary wireless communication device is described in U.S. patent application Ser. No. 08/705.043, which names James O'Toole, John R. Tuttle, Mark E. Tuttle, Tyler Lowrey, Kevin Devereaux, George Pax, Brian Higgins, Shu-Sun Yu, David Ovard and Robert Rotzoll as inventors, which was filed on Aug. 29, 1996, is assigned to the assignee of this patent application, and is fully incorporated herein by reference.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming an antenna comprising:

providing a polyester substrate having an outer surface;

forming a first layer of conductive material over the outer surface;

forming a second layer of conductive material over only a portion of the first layer, the second layer having a lower conductivity than the first layer and defining the antenna; and etching the first layer selectively relative to the second layer using the second layer as a masking layer to provide at least one conductive line comprising the first and second layers.

2. The method of claim 1, wherein the substrate is flexible prior to the forming of the first layer.

3. The method of claim 1, wherein the forming of the second layer comprises screen-printing the second layer.

4. The method of claim 1, wherein the forming of the first layer comprises forming a copper-comprising layer.

5. The method of claim 1, wherein the forming of the second layer comprises forming a silver-comprising layer.

6. The method of claim 5, wherein the forming of the second layer comprises screen-printing the second layer.

7. A method of forming an antenna comprising:

providing a substrate having an outer surface;

forming a first layer of conductive material over the outer surface;

forming a second layer of conductive material over only a portion of the first layer, the second layer having a lower conductivity than the first layer and defining the antenna; and etching the first layer selectively relative to the second layer using the second layer as a masking layer to provide at least one conductive line comprising the first and second layers, wherein:

the forming of the first layer comprises forming a copper-comprising layer over the outer surface; and the forming of the second layer comprises screen-printing a silver-comprising polymer layer over the copper-comprising first layer.

8. A method of forming an antenna comprising:

providing a polyester substrate having an outer surface;

forming a conductive first layer of metal-comprising material over the outer surface;

printing a conductive second layer of material over only a portion of the first layer, the printed second layer defining the antenna, the second layer material being less electrically conductive than the first layer of metal-comprising material; and selectively etching the first layer relative to the second layer to provide at least one conductive line comprising the first and second layers.

9. The method of claim 8, wherein the second layer is thicker than the first layer.

10. The method of claim 8, wherein the forming of the first layer comprises forming a copper-comprising layer over the outer surface.

11. The method of claim 8, wherein the second layer of material comprises a silver-comprising polymer.

12. The method of claim 8 further comprising:

mounting an integrated circuitry chip and a battery on the substrate; and operably connecting the integrated circuitry chip, the battery and the antenna.

13. A method of forming an antenna comprising:

forming at least two conductive layers on a polyester substrate, the two layers being of different materials with one being formed over the other, the one being formed into a desired antenna shape, the one layer being less conductive than the other layer; and etching the other selectively relative to the one to form an antenna of the desired shape comprising the two conductive layers of different materials.

14. The method of claim 13, wherein the one layer comprises a silver-comprising material.

15. The method of claim 13, wherein the forming of the layers comprises at least two separate steps.

16. The method of claim 13, wherein the forming of the one layer comprises printing the one layer onto the other layer.

17. A method of forming an antenna comprising:

forming at least two conductive layers of different materials with one being formed over the other, the one being formed into a desired antenna shape, the one layer being less conductive than the other layer; and etching the other selectively relative to the one to form an antenna of the desired shape comprising the two conductive layers of different materials, wherein:

the other layer comprises copper;

the one layer comprises a silver-comprising material;

the forming of the layers comprises at least two separate steps; and the forming of the one layer comprises screen printing the one layer onto the other layer.

18. A method of forming an antenna comprising:

providing a polyester substrate having an outer surface;

coating the outer surface with a first layer of conductive material having a first conductivity; and printing a conductive antenna component over only a portion of the first layer, the antenna component having a second conductivity which is less than the first conductivity.

19. The method of claim 18, wherein the substrate is flexible prior to the coating of the outer surface.

20. The method of claim 19, wherein the first layer is thinner than the second layer.

21. The method of claim 18, wherein the printing of the conductive antenna component comprises printing a silver-comprising material over the first layer.

22. The method of claim 21, wherein the coating of the outer surface comprises forming a copper-comprising layer thereover.

23. The method of claim 22, wherein the first layer is thinner than the second layer.

24. The method of claim 21, wherein the first layer is thinner than the second layer.

25. A method of forming an antenna comprising:

providing a polyester substrate;

blanket depositing a metal-comprising layer of material over the substrate, the metal-comprising layer including copper;

masking portions of the metal-comprising layer of material with a conductive antenna component, the metal-comprising layer being more conductive than the antenna component; and removing unmasked portions of the metal-comprising layer selectively relative to the antenna component.

26. The method of claim 25, wherein the masking of the metal-comprising layer comprises printing the antenna component thereover.

27. The method of claim 26, wherein the printing comprises screen-printing a silver-comprising material thereover.

28. The method of claim 25, wherein the masking of the metal-comprising layer comprises forming a silver-comprising material thereover.

29. The method of claim 25, wherein the removing of the unmasked portions of the metal-comprising layer comprises anisotropically etching the metal-comprising layer.

30. A method of forming a wireless communication device comprising:

providing a polyester substrate;

forming a first layer of conductive material over the substrate;

forming a second layer of conductive material over the first layer of conductive material, the first layer of material being more conductive than the second layer of material;

selectively etching the first layer of material relative to the second layer of material to provide an antenna;

mounting an integrated circuit chip to the substrate in electrical communication with the antenna; and encapsulating the chip and antenna in an encapsulant.

31. The method of claim 30, wherein the forming of the second layer comprises printing a silver-comprising layer over the first layer.

32. The method of claim 31, wherein the second layer comprises a polymer.

33. The method of claim 30, wherein the first layer is thinner than the second layer.

34. The method of claim 33, wherein the first layer is more conductive than the second layer.

* * * * *